United States Patent [19]

Holl et al.

[11] 4,391,214

[45] Jul. 5, 1983

[54] METHOD AND DEVICE FOR FORMING AN OVERCAST SEAM BY MEANS OF A ZIGZAG SEWING MACHINE

[75] Inventors: Helmar Holl; Rolf Kessler, both of Karlsruhe, Fed. Rep. of Germany

[73] Assignee: Dorina Nähmaschinen GmbH, Fed. Rep. of Germany

[21] Appl. No.: 297,415

[22] Filed: Aug. 28, 1981

[30] Foreign Application Priority Data

Sep. 19, 1980 [DE] Fed. Rep. of Germany ..... 80105642[U]

[51] Int. Cl.[3] ..... D05B 1/20; D05B 3/02

[52] U.S. Cl. ..... 112/269.1; 112/158 R; 112/162

[58] Field of Search ..... 112/269.1, 158 R, 162, 112/235, 262.1, 268.1

[56] References Cited

U.S. PATENT DOCUMENTS

| | | | |
|---|---|---|---|
| 1,509,111 | 9/1924 | Saleeby | 112/269.1 |
| 2,849,976 | 9/1958 | Sanseverinati | 112/162 |
| 2,973,731 | 3/1961 | Sigoda | 112/162 |
| 3,126,850 | 3/1964 | Sigoda | 112/162 |
| 4,155,320 | 5/1979 | Aubort | 112/269.1 |
| 4,250,824 | 2/1981 | Meier et al. | 112/269.1 |

*Primary Examiner*—H. Hampton Hunter
*Attorney, Agent, or Firm*—McGlew and Tuttle

[57] ABSTRACT

A method and a device for the formation of an overcast seam using a zigzag sewing machine are disclosed. After the formation of a first loop in an overstitch position of the needle bar, the needle bar, while the needle thread is slackened and the fabric is moved by one stitch length, changes to a second overstitch position in which another thread loop is made. Thereupon, the needle thread, leading from the first to the second thread loop, is pulled out to form a loop in the first overstitch position while the fabric is fed by another stitch length, the loop being offered to the needle for the stitching and released after stitching. The oversew mandrel of the device for implementing the method includes a double lever loop stripper. One arm of the double lever supplements the oversew mandrel and serves as the thread loop stripper. The other arm has a slide surface which projects into the path of motion of the needle fastening screw in the first overstitch position of the needle bar. The arm of the double lever supports a holding member for the thread loop, interacting with a thread loop retaining projection of the oversew mandrel. The device is disposed in its own housing connected to the fabric presser of the sewing machine.

7 Claims, 7 Drawing Figures

METHOD AND DEVICE FOR FORMING AN OVERCAST SEAM BY MEANS OF A ZIGZAG SEWING MACHINE

FIELD AND BACKGROUND OF THE INVENTION

The present invention relates, in general, to sewing machines and, more particularly, to a new and useful method and device for the formation of an overcast seam by means of a zigzag sewing machine.

U.S. Pat. No. 4,250,824 discloses a method for forming an overcast seam by means of zigzag sewing machine which provides that, after a first intertwining of needle thread and looper thread, in a first overstitch position of the needle bar the needle bar alternate into a second overstitch position to form a second intertwining of the thread, the needle thread being laid over an oversew mandrel and thereby slackened. In the second overstitch position of the needle bar, at least one straight stitch is then formed, whereupon the needle thread, leading from the first to the second thread loop, is pulled out to form a loop, in the next following alternation of the needle bar into the first overstitch position, is offered to the needle for stitching and then released. The alternation of the needle bar into the respective other overstitch position takes place while the material feed is interrupted. To obtain a particularly loose seam, the piece of thread between the first and second thread loop is pulled out while the material feed is reversed. The progressive seam formation is achieved exclusivly by executing at least one straight stitch within a basic overcast seam formation of at least four stitches.

Due to feeding intermissions or the execution of a reverse stitch, the progressive seam formation suffers from a significant delay so that the effective feed rate and, hence, the sewing time are adversely affected. This method can be economically executed only on zigzag machines equipped with controls for the needle bar and the fabric feeder.

The oversew mandrel, in the device for the implementation of the known method, serving to slacken and pull out the needle thread leading from the first to the second thread loop of a basic overcast seam formation, is of hookshaped design at its free end to prevent slip off of the thread to be pulled. However, when stiff or slippery threads are used, this is not a sufficient safety measure to insure against slipping off. While such slipping off could be prevented, to a great extent, by opening the hook up more, this would cause stripping problems for the pulled-out thread loop because, for stripping, the oversew mandrel of the known device is moved past and caused to make contact with a loop stripper hoop fastened to the front edge of the fabic presser of the sewing machine. If a more widely opened oversew mandrel were used for better security against the thread loop slipping off, the thread in the known device would be unduly stressed when stripping the thread loop.

SUMMARY OF THE INVENTION

It is an object of the present invention to provide a method and a device for its implementation which makes it possible to produce an overcast seam considerably faster; to assure gentle thread treatment and complete safety against the thread loop to be pulled out slipping off the oversew mandrel; and to permit sewing the overcast seam on any standard zigzag sewing machine.

The overcast seam can be sewn by the present method at the same feed rate as a normal zigzag seam.

In accordance with the invention, in a method for the formation of an overcast seam using a zigzag sewing machine of the type having a fabric presser, a needle bar carrying a needle with a needle thread movable into first and second overstitch position, the needle being movable in axial reciprocating motions, and pendulum motions selectively oriented transverse thereto between the first and second overstitch positions, a looper carrying a looper thread and a fabric feeder for feeding a fabric in a feed direction, the method being of the type having the steps of forming a first intertwining of the needle thread and needle looper thread in the first overstitch position, then moving the needle bar with the needle thread into the second overstitch position thereby slackening the needle thread, then forming a second intertwining needle needle thread and looper thread in the second overstitch position whereby the slackened needle thread leading from the first to the second thread loop is pulled into the first overstitch position to form an overstitch loop into which the needle is inserted to form a subsequent loop and then released, there is provided the improvement, in combination therewith, comprising the steps of moving the needle bar into the second overstitch position and concurrently feeding the fabric sewn by one stitch in the feed direction.

In sewing, the thread loop is laid across both the oversew mandrel and the stripper but can also be lifted off the oversew mandrel and released very easily and gently. A particularly simple control of the stripper, derived from the axial needle bar motion, is achieved by using the stripper to supplement the oversew mandrel and controlling the stripper by the movement of the needle bar in the first overstitch position. The stripper is preferably pivotally mounted to the oversew mandrel and designed as a dual-armed lever, having one arm which supplements the oversew mandrel and another arm which protrudes into the path of the motion of the needle bar in the first overstitch position. Accordingly, in a zigzag sewing machine of the type having a fabric presser, a needle bar carrying a needle with a needle thread movable into first and second overstitch positions, the needle being movable in axial reciprocating motions and pendulum motions selectively oriented transverse thereto between the first and second overstitch positions, and a fabric feeder for feeding a fabric in a feed direction, there is provided an improved device for forming an overcast seam, the device being of the type having an oversew mandrel with first and second means for respectively moving the mandrel into two successive positions responsive to rotary and axial movement of the needle to form an overstitch loop in the needle path, and a loop stripper for disengaging the overstitch loop from the oversewn mandrel, wherein the improvement comprises the loop stripper being movably mounted to the oversew mandrel for movement responsive to the axial movement of the needle bar in the first overstitch position, the loop stripper including a first arm portion adjacent to the oversew mandrel to supplement the formation of an overstitch loop. The stripper is preferably pivotally mounted to the oversew mandrel and the stripper preferably includes a second arm portion protruding into the axial path of the needle bar in the first overstitch position.

The thread loop is effectively prevented from slipping off during the pull-out motion of the oversew mandrel by the feature of the first arm of the stripper supporting a holding member whose free end is movable to make contact with the oversew mandrel so that holding member and oversew mandrel form virtually a closed eye for the thread loop when being pulled out.

Due to the feature of the free end of the holding member being liftable off the oversew mandrel in the second overstitch position, the stripper being slidable over a slide surface of the fabric presser, so that the eye is opened in very simple manner for the entry of the thread loop and closed for the pull-out.

Due to the design and configuration of the device according to a preferred embodiment in which the improved device is disposed in its own housing connected to the fabric presser of the sewing machine and having a shaft supporting the oversew mandrel, characterized in that the shaft is disposed in a bearing yoke mounted to the stitch plate of the sewing machine and projecting into the housing and is joined, together with the housing, to the fabric presser, via a driver, it follows all vertical fabric presser motions.

A device incorporating each of the features of the various embodiments is particularly suited as an accessory for any standard zigzag sewing machine.

In accordance with the invention, there is provided an improved method and apparatus for the formation of an overcast seam using a zigzag sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
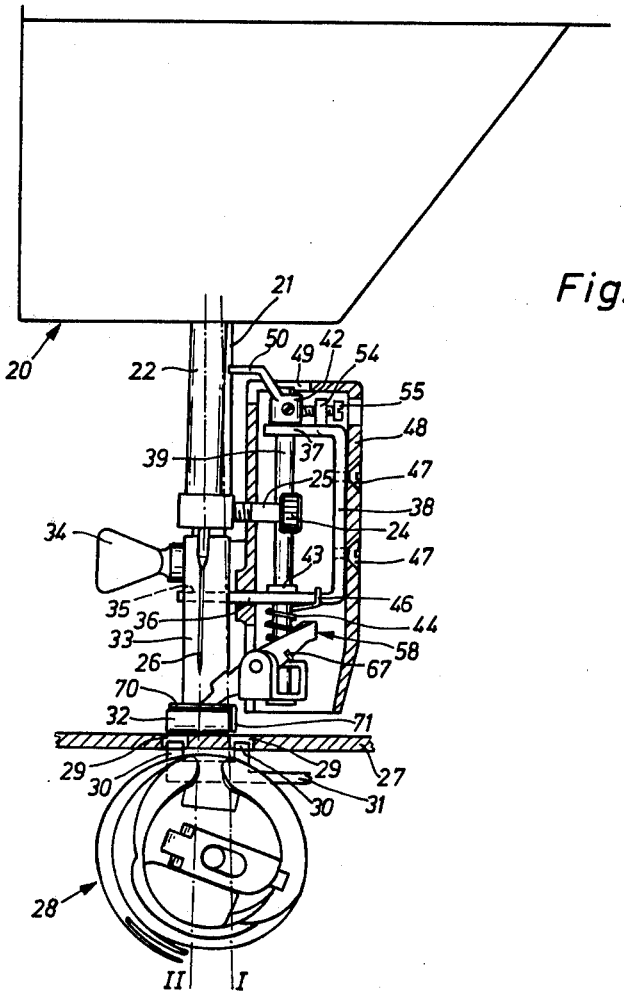
FIG. 1 shows an embodiment example of the device for the implementation of the method, intended to be fastened to the fabric presser of a zigzag sewing machine.

Referring now to the drawings, in particular, wherein like reference characters designate like or corresponding parts throughout the several views, there is shown a head 20 of the zigzag machine which has a spring-loaded fabric presser bar 21 and a needle bar 22. A needle holder 23 is disposed at the lower end of the needle bar 22 in which the needle 26 is fastened by a fastening screw 25 having a screw cylindrical head 24. The needle 26 interacts with a thread-carrying looper 28 that is disposed under a needle plate 27 to form double lock stitches. Vertical up and down motions and pendulum motions imparted to the needle bar 22 in known manner selectively oriented transverse thereto are between the overstitch positions marked I and II in FIGS. 1 and 2.

The needle plate 27 is provided with a slot for the needle 26 to pass through and has two longitudinal slots 29 through which toothed webs 30 of a fabric feeder 31, performing a rectangular motion in the usual known manner, penetrate upwardly to feed the material being sewn.

The sole 32 of the fabric presser of the sewing machine, articulated in a shaft 33, interacts with the webs 30 of the fabric feeder 31. The shaft 33 is mounted, by means of a thumb screw 34, to the lower end of the fabric presser bar 21 which is spring-loaded in downward direction by a fabric presser spring (not shown). The shaft 33 has a cutout 35 through which the one bearing leg 36 of a bearing yoke 38 having two angularly bent bearing legs 36 and 37 is led and in which a shaft 39 is mounted so as to be rotatable and movable lengthwise. The bearing yoke is fastened to the shaft 33 by means of a screw (not shown). Due to the connection, shaft 33, bearing leg 36 and the shaft 39 follow all vertical motions of the fabric presser.

Figure 2:
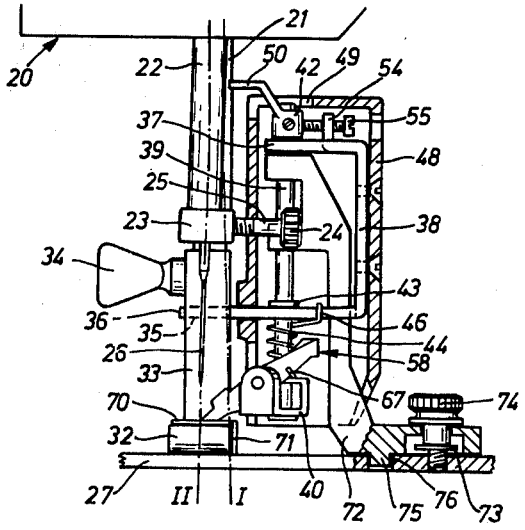
FIG. 2 is an embodiment example of the device for the implementation of the method, intended to be fastened to the stitch plate of a zigzag sewing machine.
Figure 3:
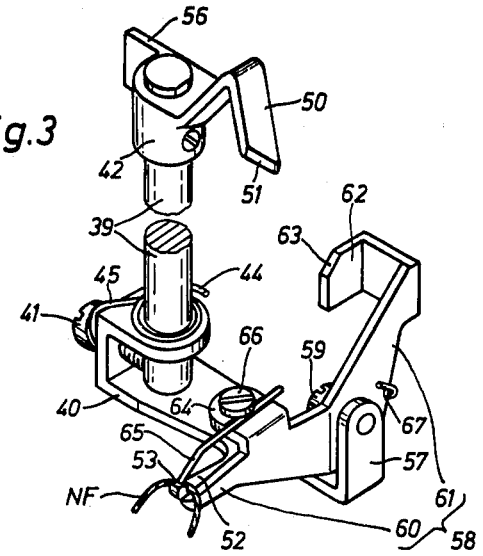
FIG. 3 is a diagrammatic view, in larger scale, of the switching shaft supporting the oversew mandrel and the stripper for the thread loop.

An angle bracket 40 is fastened to the lower end of the shaft 39 protruding through the bearing leg 36, by means of a screw 41 as shown in FIG. 3. The shaft 39 is axially secured by a control lever 42 mounted to its upper end and by a retaining ring 43, FIGS. 1 and 2. A torsion spring 44 is disposed between the bearing leg 36 and the angle bracket 40 on the shaft 39. The torsion spring 44 has two free legs 45 46, one of which leg 45, is supported against the bearing leg 36 while the other, leg 46, bears against the angle bracket 40. The bearing leg is fastened by means of screws 47 to a housing 48 which encloses the components of the device and may be of multipart design for easier assembly. The control lever 42 has a free end 50, bent up and penetrating a cutout in the housing 48, with a beveled slide surface 51, FIG. 3, which interacts with the needle bar 22 to turn the shaft 39.

An oversew mandrel 52 is formed on the angle bracket 40. The oversew mandrel 52 has a bent-up retaining projection 53 for the needle thread loop and which projects outwardly through an opening in the housing 48 to beyond the needle slot. The torsion spring 44 pushes the angle bracket 40 with the oversew mandrel 52 into its end position. The end positon is determined by an adjustable stop screw 55 which is screwed into a tab 54 of the bearing leg 38 and interacts with a lug 56 of the control lever 42, FIG. 3.

Figure 4:
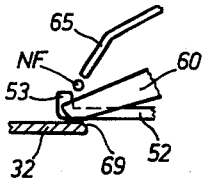
FIGS. 4 to 6 show the free ends of oversew mandrel, thread stripper, thread holding member and fabric presser sole in three different operating phases.
Figure 5:
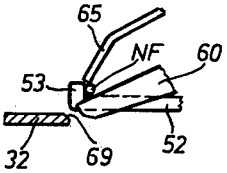
Figure 6:
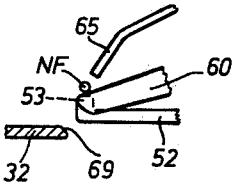

A needle thread loop stripper 58, designed as dual-armed lever, is mounted to a bent-up bearing leg 57 of the angle bracket 40 so as to pivot about a shoulder screw 59, FIG. 3. The one arm 60 projects towards the needle 26. The front end of the arm 60 is disposed parallel to the oversew mandrel 52 and supplements it. The other arm 61 of the stripper 58 projects obliquely upward. The end of the other arm 61 is bent into an L-shaped with a free leg 62 that has a beveled slide surface 63 which projects into the path of motion of the cylinder head 24 of the needle fastening screw 25 in the overstitch position I of the needle bar 22. A bent tab 64 is provided on the arm 60 of the stripper 58 to fasten, by means of a screw 66, a spring wire holding member 65 for the needle thread loop. The front portion of the holding member 65 is bent downwardly. To pull out a needle thread loop, the free end of the holding member 65 positions itself against the retaining projection 53 of the oversew mandrel 52 (FIG. 5) due to the action of a torsion spring 67. In the thread catching position (FIG. 4), the front end of the arm 60 of the stripper 58 contacts a contact surface 69 of the fabric presser sole 32, whereby the arm 60, and with it the holding member 65, are raised somewhat so that a gap is formed between the retaining projection 53 and the holding member 65 through which a needle thread loop laid over the holding member 65, the oversew mandrel 52 and the arm of the stripper 58 can enter, thus getting behind the retaining projection 53 of the oversew mandrel 52. As mentioned, to pull the needle thread loop out, the gap is closed by the spring 67, as shown in FIG. 5, so that oversew mandrel 52 and holding member 54 form an eye, for all practical purposes. In the thread loop release position (FIG. 6), the stripper 58 is pivoted about the shoulder screw 59, countering the force of the torsion spring 67, due to the cylindrical screw head 24 of screw 25 making contact with the slide surface 63, thereby raising the arm 60 of the stripper 58 beyond the retaining projection 53 of the oversew mandrel 52 and lifting the holding member 65 off the retaining projection 53. The pulled-out needle thread loop can thus slip over the retaining projection 53 unhindered.

To guide the lateral edge of the fabric W being sewn, as shown in FIGS. 1 and 2, a straight edge 70 is attached by a downwardly bent guide leg 71 of the fabric presser sole 32.

In the second embodiment of the device, as shown in FIG. 2, the shaft 39 is mounted, for stabilization, in a bearing bracket 72. Bearing bracket 72 has a foot part, fastened to the stitch plate 27 of the sewing machine, by means of a knurled screw 74 secured against getting lost by a locking ring 73. The underside of the foot part of the bearing bracket 72 has a rib 75 engaging a recess 76 in the stitch plate 27 to keep it in place.

The implementation of the method and operating mode of the device, may be described as follows. It is assumed that the edge of the fabric W to which the seam is to be applied abuts the guide leg 71 of the straight edge 70 as the fabric rests on the stitch plate 27, against which it is pressed by the usual fabric presser bar spring via the fabric presser sole 32 disposed on the shaft 33; that the sewing machine, set up for making zigzag stitches, is stopped with the needle in up position; and that no thread loop has been formed yet.

Figure 7:
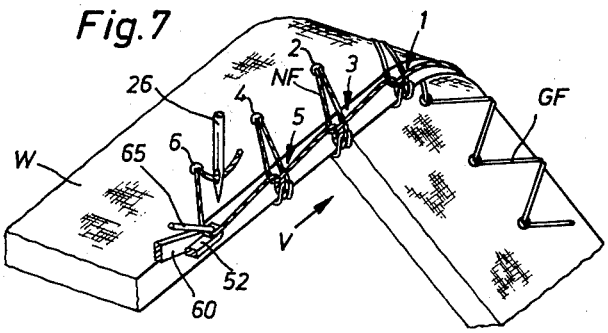
FIG. 7 is an enlarged, diagrammatic view of an overcast seam at the edge of a piece of cloth, produced by the new method.

If the sewing machine is then started, the needle 26 will first enter in point 1 (FIG. 7) in the overstitch position I. (FIGS. 1, 2) of the needle bar 22, to form the first loop of needle thread NF and looper thread GF, the thread ends being held by the operator at the start of sewing. To form the overcast seam, the needle bar 22 changes to the overstitch position II while the fabric feeder 31 feeds the fabric W by one stitch length for the needle 26 to enter in point 2. In this process, the oversew mandrel 52, the arm 60 of the stripper 58 and the holding member 65 assume their positions shown in FIG. 5, while the shaft 39, carrying the control lever 42 and the angle bracket 40 with the device components follows the pendulum motion of the needle bar 22 due to the action of the torsion spring 44, and the needle thread NF, going to point 1, is laid across the holding member 65, the oversew mandrel 52 and the arm 60 of the stripper 58 so that its length is greater than the distance from 1 to 2. Shortly before the needle bar 22 reaches the overstitch position II, the free end of the arm 60 of the stripper 58 contacts the slide surface 69 of the fabric presser sole 32, whereby the arm 60 of the stripper 58, and with it the holding member 65 also, are raised somewhat so that a gap is formed between the free end of the holding member 65 and the retaining projections 53, as shown in FIG. 4, through which the needle thread NF passes during the downward motion of the needle bar 22, getting behind the retaining projection 53. After needle thread and looper thread are intertwined by the looper 28, the needle bar 22 changes back into the overstitch position I again, the fabric W is fed by another switch length in the direction of arrow V for the needle 26 to enter at 3, FIG. 7 while the needle 26 is outside of the fabric W.

During the pendulum motion of the needle bar 22, the shaft 39, including the oversew mandrel 52, the stripper 58 and the holding member 65, is turned due to the control lever 42 interacting with the needle bar 22, countering the force of the torsion spring 44. In this process, the arm 60 of the stripper 58 disengages from the slide surface 69 of the fabric presser sole 32 first, and the stripper 58 is pivoted by the torsion spring 67 about the shoulder screw 59 counterclockwise, relative to FIG. 3, so that the gap between the retaining projection 53 and the holding member 65 is closed. As the rotary motion of shaft 39 continues, the needle thread NF, reaching from the first to the second loop is pulled out to form a loop and offered to the needle 26 to enter in the overstitch position I. As soon as the needle 26 has entered this thread loop at 3, FIG. 7, the cylinder head 24 of the needle fastening screw 25 strikes the contact surface 63 of the leg 61 of stripper 58, pivoting it together with the holding member 65 clockwise, relative to FIG. 3, about the shoulder screw 59, including the top edge of arm 60 engaging the thread loop, to beyond the retaining projection 53 (see FIG. 6). During the so-called stitch gathering motion of the usual thread lever of the sewing machine, the thread loop can slip unhindered over the retaining projection 53. It is bound by the looper thread GF at the outside edge of the fabric in point 3. With the completion of this intertwining of needle thread and looper thread a basic overcast seam formation has been made. The reference numerals 4 to 6 in FIG. 7 designate the further sequence of stitches as the formation of the overcast seam progresses, the fabric W being fed by one stitch length in feeding direction of arrow V, FIG. 7 between two stitch formations each. Therefore, the overcast seam is being sewn at the same feed rate as a normal zigzag seam.

Since the pendulum motions of the needle bar suffice to control the device, any standard zigzag sewing machine can be used to carry out the method, employing the new device.

Thus, in accordance with the invention, a method is provided for the formation of an overcast seam by means of a zigzag sewing machine 20 in which method there takes place, after the formation of a first intertwining of needle thread NF and looper thread GF and in a first overstitch position I of the needle bar 22 and after the needle bar 22 has changed to a second overstitch position II with slackening of the needle thread NF, a second thread intertwining, whereupon the needle thread NF, leading from the first to the second thread loop, is pulled into the first overstitch position I under formation of a loop, which loop is offered to the needle 26 for the next stitch and then released, characterized in that the change of the needle bar 22 into the respective other overstitch position takes place while the material W being sewn is fed by one stitch length each in feeding direction (arrow V).

A device is provided for the implementation of the method, having an oversew mandrel 52 carrying out two successive phases of motion and with a stripper 58 for the thread loop, characterized in that the stripper 58 supplements the oversew mandrel 52 and is controllable by the needle bar 22 in the one stitch position I. The device is further characterized in that the stripper 58 is pivotably mounted to the oversew mandrel 52 and designed as dual-armed lever 60,61 having one arm 60 which supplements the oversew mandrel 52 and one other arm 61 which protrudes into the path of motion of the needle bar 22 in the one overstitch position, I. The device is preferably even further characterized in that the first arm of the stripper 58 supports a holding member 65 whose free end is movable to make contact with the oversew mandrel 52. The device is preferably even still further characterized in that the free end of the holding member 65 is liftable off the oversew mandrel 52 in the second overstitch position II in that the stripper 58 slides over a slide surface of the fabric presser 32. In a preferred embodiment the device is characterized in that it is disposed in its own housing 48 connected to the fabric presser 32 of the sewing machine 20. The device may have a shaft 39 supporting the oversew mandrel 52, characterized in that the shaft 39 is disposed in a bearing yoke 38 mounted to the stitch plate 27 of the sewing machine 20 and projecting into the housing 48 and is joined, together with the housing 48, to the fabric presser 32, 33 via a driver 36.

Thus, the present invention is directed to a method and device for the formation of an overcast seam by means of a zigzag sewing machine. After formation of a first loop in an overstitch position I of the needle bar 22, the needle bar 22, while the needle thread NF is slackened and the fabric W is moved by one stitch length, changes to a second overstitch position II in which another thread loop is made. Thereupon, the needle thread NF, leading from the first to the second loop, is pulled out to form a loop in the first overstitch position I while the fabric W is fed by another stitch length, the loop is offered to the needle 26 for stitching and released after stitching.

The oversew mandrel 52 of the device for the implementation of the method includes as double lever loop stripper 58. One arm 60 of the double lever 58 supplements the oversew mandrel 52 and serves as thread loop stripper. The other arm 61 has a slide surface 63 which projects into the path of motion of the needle fastening screw 25 in the overstitch position I of the needle bar 22. The arm 60 of the double lever 58 supports a holding member 65 for the thread loop, interacting with a thread loop retaining projection 53 of the oversew mandrel 52. The device is disposed in its own housing 48 connected to the fabric presser 32,33 of the sewing machine 20.

While specific embodiments of the invention have been shown and described in detail to illustrate the application of the principles of the invention, it will be understood that the invention may be embodied otherwise without departing from such principles.

What is claimed is:

1. In a method for the formation of an overcast seam using a zigzag sewing machine of the type having a fabric presser, a needle bar carrying a needle with a needle thread movable into first and second overstitch positions, the needle being movable in axial reciprocating motions and pendulum motions selectively oriented transverse thereto between the first and second overstitch positions, a looper carrying a looper thread and a fabric feeder for feeding a fabric in a feed direction, the method being of the type having the steps of forming a first intertwining of the needle thread and the looper thread in the first overstitch position, then moving the needle bar with the needle thread into the second overstitch position thereby slackening the needle thread, then forming a second intertwining needle thread and looper thread in the second overstitch position whereby the slackened needle thread leading from the first to the second thread loop is pulled into the first overstitch position to form an overstitch loop into which the needle is inserted to form a subsequent loop and then released, the improvement, in combination therewith, comprising the steps of moving the needle bar into the second overstitch position and concurrently feeding the fabric being sewn by one stitch length in the feed direction.

2. In a zigzag sewing machine of the type having a fabric presser, a needle bar carrying a needle with a needle thread movable into first and second overstitch positions, the needle being movable in axial reciprocating motions and pendulum motions selectively oriented transverse thereto between the first and second overstitch positions, A looper carrying a looper thread, and a fabric feeder for feeding a fabric in a feed direction, an improved device for forming an overcast seam, the device being of the type having an oversew mandrel with first and second means for respectively moving the mandrel into two successive positions responsive to rotary and axial movement of the needle to form an overstitch loop in the needle path, and a loop stripper for disengaging the overstitch loop from the oversew mandrel, comprising the improvement wherein the loop stripper is movably mounted to the oversew mandrel for movement responsive to the axial movement of the needle bar in the first overstitch position, the loop stripper including a first arm portion adjacent to the oversew mandrel to supplement the formation of an overstitch loop.

3. The improved combination of claim 2, wherein the stripper is pivotally mounted to the oversew mandrel, and wherein the stripper comprises a second arm portion protruding into the axial path of the needle bar in the first overstitch position.

4. The improved combination of claim 2 or 3 further comprising an elongated holder member movably mounted to the stripper, the holder member including a free end movable into and out of contact with the oversew mandrel.

5. The improved combination of claim 4, wherein the fabric presser includes a slide surface, and the stripper being slidable on said slide surface to move said free end of said holding member out of contact with the oversew mandrel in the second overstitch position.

6. The improved combination of claim 5, further comprising a housing connected to the fabric presser, and said improved device being disposed within said housing.

7. The improved device as set forth in claim 6 further comprising a shaft operatively connected to the fabric presser and said housing for rotary movement, said shaft carrying said oversew mandrel for rotary and axial movement therewith.

* * * * *